US007126069B2

(12) United States Patent
Mukougawa et al.

(10) Patent No.: US 7,126,069 B2
(45) Date of Patent: Oct. 24, 2006

(54) ELECTRONIC APPARATUS WITH OPERATION BUTTON

(75) Inventors: Hidenobu Mukougawa, Echizen (JP); Daisuke Shimizu, Echizen (JP); Takayuki Horie, Echizen (JP); Tsuyoshi Yoshida, Echizen (JP)

(73) Assignee: Orion Electric Co., Ltd., Fukui (JP)

( * ) Notice: Subject to any disclaimer, the term of this patent is extended or adjusted under 35 U.S.C. 154(b) by 0 days.

(21) Appl. No.: 11/331,195

(22) Filed: Jan. 13, 2006

(65) Prior Publication Data

US 2006/0180448 A1 Aug. 17, 2006

(30) Foreign Application Priority Data

Jan. 28, 2005 (JP) ..... 2005-021970

(51) Int. Cl.
*H01H 1/64* (2006.01)

(52) U.S. Cl. ..... 200/293; 200/343

(58) Field of Classification Search ..... 200/293–296, 200/341–343

See application file for complete search history.

(56) References Cited

U.S. PATENT DOCUMENTS 5,087,802 A * 2/1992 Guilleminot ..... 200/343
6,201,202 B1 * 3/2001 Katagiri ..... 200/513
6,356,196 B1 * 3/2002 Wong et al. ..... 340/571
6,555,769 B1 * 4/2003 Stefura ..... 200/5 R
6,570,111 B1 * 5/2003 Nakagawa et al. ..... 200/343
6,580,045 B1 * 6/2003 Kuo ..... 200/559
6,914,206 B1 * 7/2005 Mukougawa ..... 200/556

FOREIGN PATENT DOCUMENTS

JP 2000-165064 6/2000
JP 2000-299567 10/2000

* cited by examiner

*Primary Examiner*—K. Lee
(74) *Attorney, Agent, or Firm*—Westerman, Hattori, Daniels & Adrian, LLP.

(57) ABSTRACT

The present invention provides an electronic apparatus with an operation button that can be easily mounted and prevents from being pushed into the electronic apparatus excessively. A front panel is provided with a button mounting portion. The front panel is further provided with an opening, a stopper portion, and a convex portion. The convex portion is fitted into a concave portion formed in an operation button to position the operation button. The operation button is sandwiched between the convex portion and a decorative panel. When an operating portion is pushed, a hinge portion formed on the operation button is bent to allow a pushing portion inserted through the opening to operate an internal switch. An abutting portion abuts against the stopper portion to inhibit the operation button from being excessively pushed in.

4 Claims, 7 Drawing Sheets

ELECTRONIC APPARATUS WITH OPERATION BUTTON

The present application is based on and claims priority of Japanese patent application No. 2005-021970 filed on Jan. 28, 2005, the entire contents of which are hereby incorporated by reference.

BACKGROUND OF THE INVENTION

1. Field of the Invention

The present invention relates to an electronic apparatus with an operation button in which a decorative panel covers the operation button placed on a front panel except for an operating portion of the operation button so that the operating portion can be pushed to operate an internal switch. In particular, the present invention relates to a practical electronic apparatus which facilitates an operation of mounting the operation button to reduce the number of parts required, the electronic apparatus being capable of using the simple structure to prevent the operation button from being excessively pushed into the electronic apparatus during a button operation.

2. Description of the Related Art

Japanese Patent Laid-Open Publication No. 2000-165064 (patent document 1) proposes a "mounting structure for a key pushing device" which is a case mounting structure for an operation button placed in a radio apparatus such as a cellular phone. With this conventional technique, a pedestal is formed inside the case so that the operation button can be mounted on the pedestal. An engaging pawl is engaged with an engaging portion formed in the case; the engaging pawl is composed of a generally L-shaped elastic member and formed on a bottom surface portion of the operation button. The bottom surface portion of the operation button is mounted on the pedestal. Thus, the operation button is fixedly positioned by the engaging pawl, the engaging portion, the pedestal, and a stopper portion without using any tightening means such as screwing or fusion; the stopper portion is provided on the pedestal.

Further, Japanese Patent Laid-Open Publication No. 2000-299567 (patent document 2) proposes a "mounting structure for a series of pushbutton pieces" which is used to mount operation buttons used for an electronic apparatus such as a television, on a front panel. With this conventional technique, one side of the series of operation buttons connected together is inserted and fitted around a guide rib formed on the inner surface side of the front panel, a positioning pin, and a positioning rib. The other side of the series of operation buttons is inserted and fitted around an end of a printed circuit board. Thus, this mounting structure is fixedly positioned without using any tightening means such as screwing or fusion.

With the above conventional techniques, for example, with the patent document 1, the need for extra time and effort may arise because the operation button is mounted inside the case. That is, when a defect such as damage occurs in the operation button, which must thus be replaced with a new one, it may be necessary to disassemble the radio apparatus, replace the operation button, and then recover the disassembled other members to their original state. Further, the pedestal, used to fix the operation button, is integrated with the case inside the case. This complicates the shape of a mold used to form the case, thus increasing the costs of the mold. Furthermore, the structure makes it difficult to reduce the sizes of the electronic apparatus such as the radio apparatus because, for example, the formation of the pedestal requires an extra internal space. With the patent document 2, when a defect such as damage occurs in the operation buttons, it may be necessary to disassemble the electronic apparatus, remove the printed circuit board, replace the operation button, and then recover the disassembled printed circuit board and other members to their original state. Further, since the mounting structure has no stopper portion that prevents the operation buttons from being excessively pushed, the lifetimes of the operation buttons are short unless the structure is provided with a separate stopper member. Or switches provided on the printed circuit board may be damaged. When a separate stopper member is provided to avoid the above situation, more parts may be required for the structure. The present invention provides an electronic apparatus with an operation button which has the following advantages. The mounting structure for the operation button is simplified to allow the operation button to be fixed to the front panel without increasing the costs of the mold or depending on tightening means such as screwing or fusion. The simple structure is used to prevent the operation button from being excessively pushed in, without the need to provide an additional separate member. The structure dispenses with the complicated operation of disassembling the electronic apparatus, replacing the operation button with a new one, and recovering the disassembled members to their original state even when the operation button becomes defective. This facilitates the operation of mounting the operation button and makes it possible to reduce the number of parts required.

SUMMARY OF THE INVENTION

A first aspect of the present invention provides an electronic apparatus with an operation button which is placed on a front panel and in which a front surface of the operation button except for its operating portion is covered with a decorative panel, the operating portion being pushed to allow a pushing portion to operate an internal switch, the pushing portion projecting from a rear surface of the operation button, wherein the front panel is provided with a button mounting portion in which the operation button is mounted for storage and the button mounting portion is provided with an opening through which the pushing portion is inserted, wherein a convex portion is integrally formed on one of the button mounting portion and the operation button and a concave portion is formed in the other of the button mounting portion and the operation button, the concave portion being fitted around the convex portion to position and hold the operation button in the button mounting portion, and wherein the operation button is provided with a hinge portion that is bent by pushing the operating portion so that the pushing portion operates the internal switch.

According to the first aspect, the operation button is positioned and held in the button mounting portion by fitting the convex portion formed on one of the button mounting portion and operation button into the concave portion formed in the other of the button mounting portion and operation button. The decorative plate covering the front surface of the operation button allows the operation button to be held between the button mounting portion and the decorative plate. With the operation button thus installed in the button mounting portion, when the operating portion exposed from a through-hole in the decorative plate is pushed, the hinge portion is bent to allow the pressing portion, formed on a rear surface of the operation button, to operate the internal switch.

A second aspect of the present invention is the electronic apparatus with the operation button according to the first aspect, wherein the operation button is mounted in the button mounting portion so that a gap is created between the operation button and the button mounting portion by the concave portion and the convex portion, a stopper portion is provided on the button mounting portion, and an abutting portion that can be abutted against the stopper portion is formed on the operation button so that when the operating portion is pushed, the abutting portion is abutted against the stopper portion to inhibit the operation button from being excessively pushed into the electronic apparatus.

According to the second aspect, when the operating portion is pushed to bend the hinge portion, the abutting portion, formed on the operation button, abuts against the stopper portion, formed on the button mounting portion. This inhibits the operation button from being excessively pushed into the electronic apparatus.

A third or fourth aspect of the present invention is the electronic apparatus with the operation button according to the first or second aspect, wherein the decorative plate is fixedly bonded to the button mounting portion using a pressure sensitive adhesive double coated tape so that the operation button is sandwiched and held between the decorative panel and the button mounting portion.

According to the third or fourth aspect, when the decorative plate is fixedly bonded to the button mounting portion using the pressure sensitive adhesive double coated tape, the operation button is sandwiched and held between the decorative plate and the button mounting portion.

DETAILED DESCRIPTION OF THE PREFERRED EMBODIMENTS

As described above, according to the present invention, an operation button placed on a front panel is positioned and held using a concave and convex fitting structure. Further, a decorative plate is mounted from a front surface of the operation button so that the operation button is sandwiched between the front panel and the decorative plate. This reduces the number of parts required for and thus costs of the electronic apparatus and also decreases the number of assembly steps required and thus the time required for operations. The present invention also prevents an operating portion of the operation button from being excessively pushed into the electronic apparatus. The description below of an embodiment relates to a DVD apparatus having an operation button placed on the front panel.

With reference to FIGS. 1 to 7, description will be given of the best mode for carrying out the present invention. Of course, the present invention can be easily applied to apparatuses different from the one described in the embodiment without departing from the spirit of the present invention.

Figure 2:
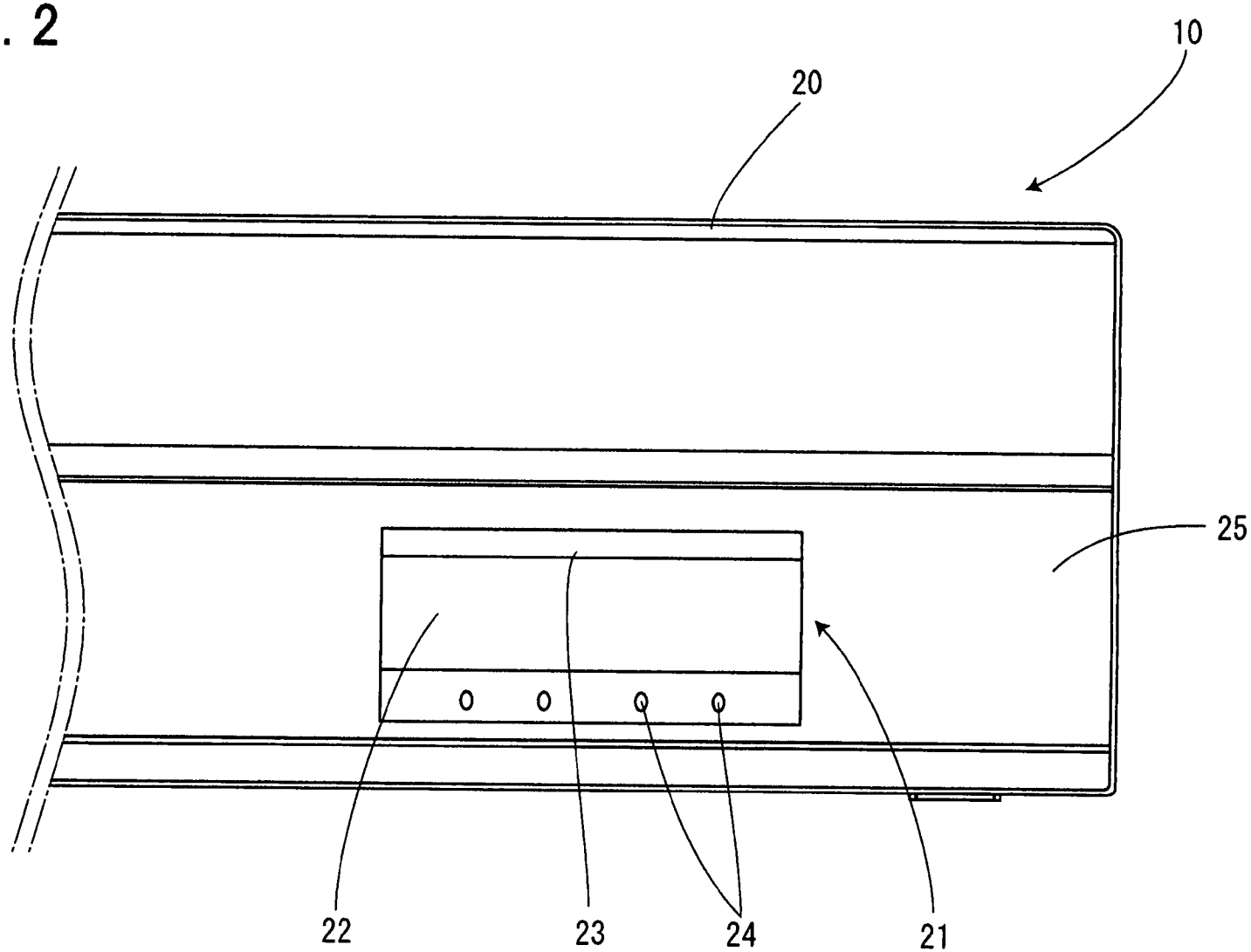
FIG. 2 is a partial front view illustrating the neighborhood of a button mounting portion of the front panel in accordance with the present invention.
Figure 3:
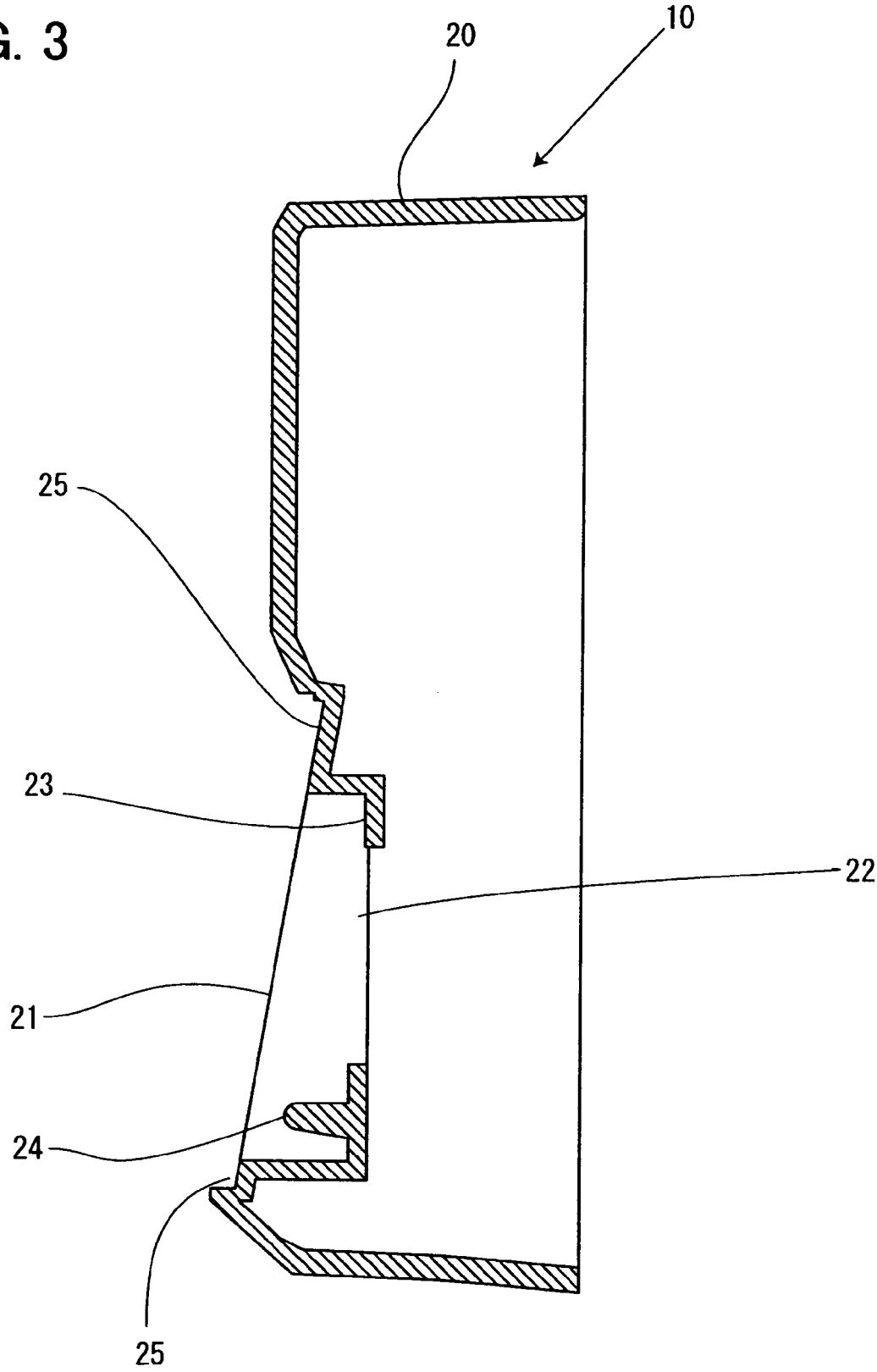
FIG. 3 is a side sectional view illustrating the neighborhood of the button mounting portion of the front panel in accordance with the present invention.

FIGS. 2 and 3 are a front view and a side sectional view showing the neighborhood of a button mounting portion on a front panel. With reference to these figures, description will be given of a front panel 20 on which an operation button (not shown) is mounted. In FIGS. 2 and 3, a button mounting portion 21 is formed in the front panel 20 so that the operation button can be mounted in the button mounting portion 21. A step portion 25 is formed on which a decorative plate is mounted, the decorative plate covering a front surface of the operation button except for at least an operating portion (not shown) of the operation button, placed in the button mounting portion 21. An opening 22 is formed in the button mounting portion 21. Four convex portions 24 are integrated with the front panel 20 so as to extend frontward from a bottom portion of the opening 22. Further, a stopper portion 23 is integrated with the front panel 20 so as to extend downward from a top portion of the opening 22.

Figure 4:
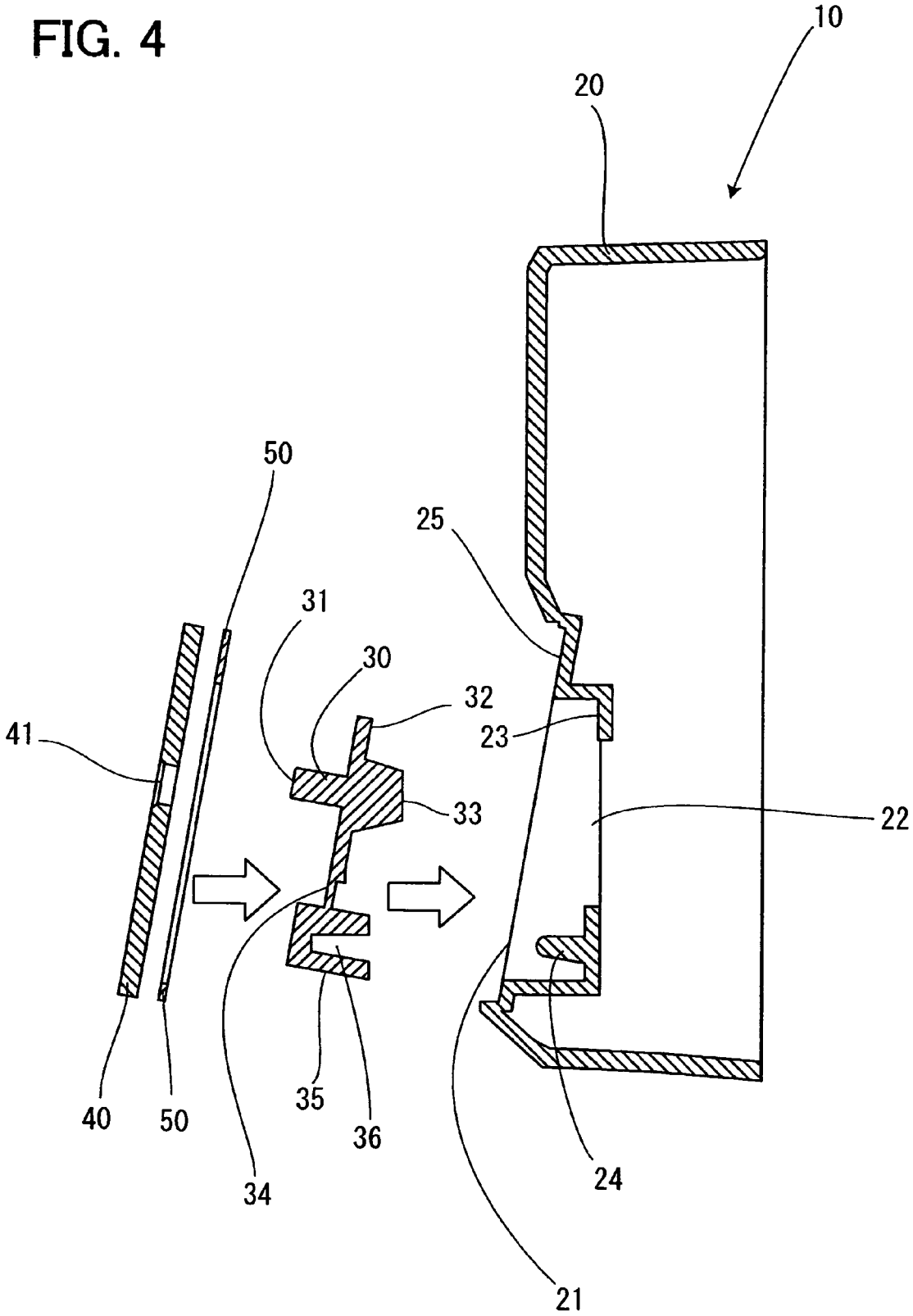
FIG. 4 is a side sectional view showing that the operation button and the decorative plate have not been mounted on the front panel yet in accordance with the present invention.

FIG. 4 is a side sectional view showing a state observed before the operation button and the decorative plate are mounted on the front panel. Description will be given of a mounting structure used to mount an operation button 30 on the front panel 20, shown in FIGS. 2 and 3, previously described. The operation button 30 is provided with a support portion 35 having a concave portion 36 formed in the lower part. The operation button 30 can be mounted by fitting the concave portion 36 around the convex portion 24, formed on the button mounting portion 21 of the front panel 20. A hinge portion 34 is provided on a top portion of the support portion 35; the hinge portion 34 forms a thin portion and is bent around the support portion 35. Moreover, the operation button 30 is provided, above the hinge portion 34, with an operating portion 31 extended frontward and exposed from the DVD apparatus 10 so as to be externally pushed by a user and a pushing portion 33 that pushes a switch (not shown) when pushed by a user and which projects from a rear surface of the operation button 30. Furthermore, a top portion of the operation button 30 forms an abutting portion 32 extending upward.

Figure 5:
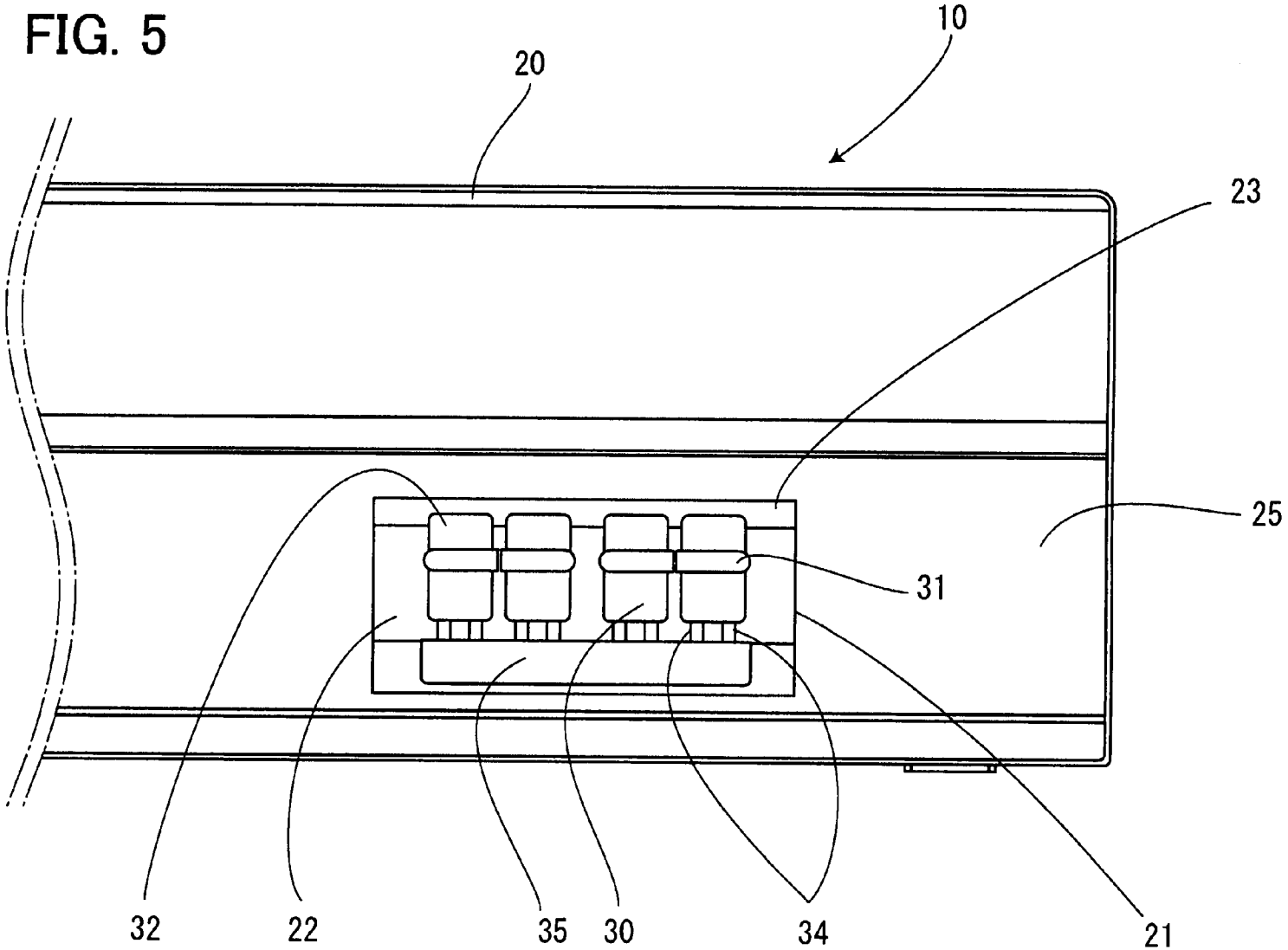
FIG. 5 is a partial front view illustrating that the operation button has been mounted on the front panel in accordance with the present invention.
Figure 6:
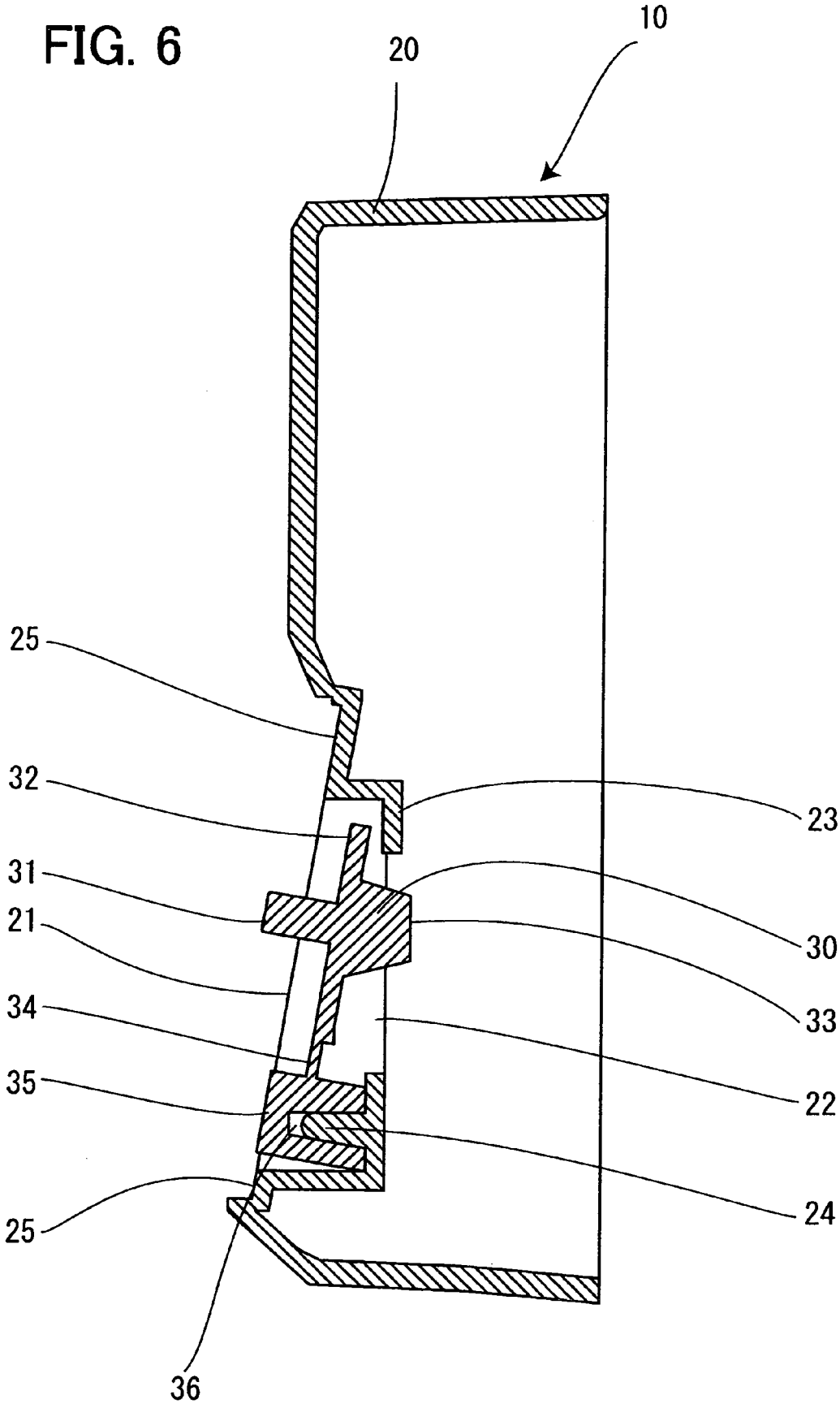
FIG. 6 is a side sectional view illustrating that the operation button has been mounted on the front panel in accordance with the present invention.

Now, with reference to FIGS. 5 and 6, description will be given of the operation button mounted on the front panel. FIG. 5 is partial front view showing that the operation button has been mounted on the front panel. FIG. 6 is a side sectional view showing that the operation button has been mounted on the front panel. In FIG. 5, the operation button 30 is placed in the button mounting portion 21 of the front panel 20; the operation button 30 is formed into four pieces located at positions corresponding to the convex portions 24 provided at four positions as in FIG. 2, previously described, and the four pieces are connected together by the support portion 35. The operation button 30 is fixedly positioned by fitting the concave portion 36 in the operation button 30 around the concave portion 24, formed on the button mounting portion 21 of the front panel 20 as shown in FIG. 6. The operation button 30 is mounted on the front panel 20 so as to create a gap between them. As shown in FIGS. 5 and 6, the operation button 30, formed into four pieces, forms the two hinge portions 34 formed to be thin and narrow, the operating portion 31 extended forward, the pushing portion 33 projecting backward from the operating portion 31, and the abutting portion 32 extending upward. When an attempt is made to excessively push the operation button 30 into the DVD apparatus 10, the abutting portion 32 abuts against the stopper portion 23, formed at the opening 22 in the front panel 20 and located opposite the abutting portion 32. This inhibits the operation button from being excessively pushed in.

Figure 1:
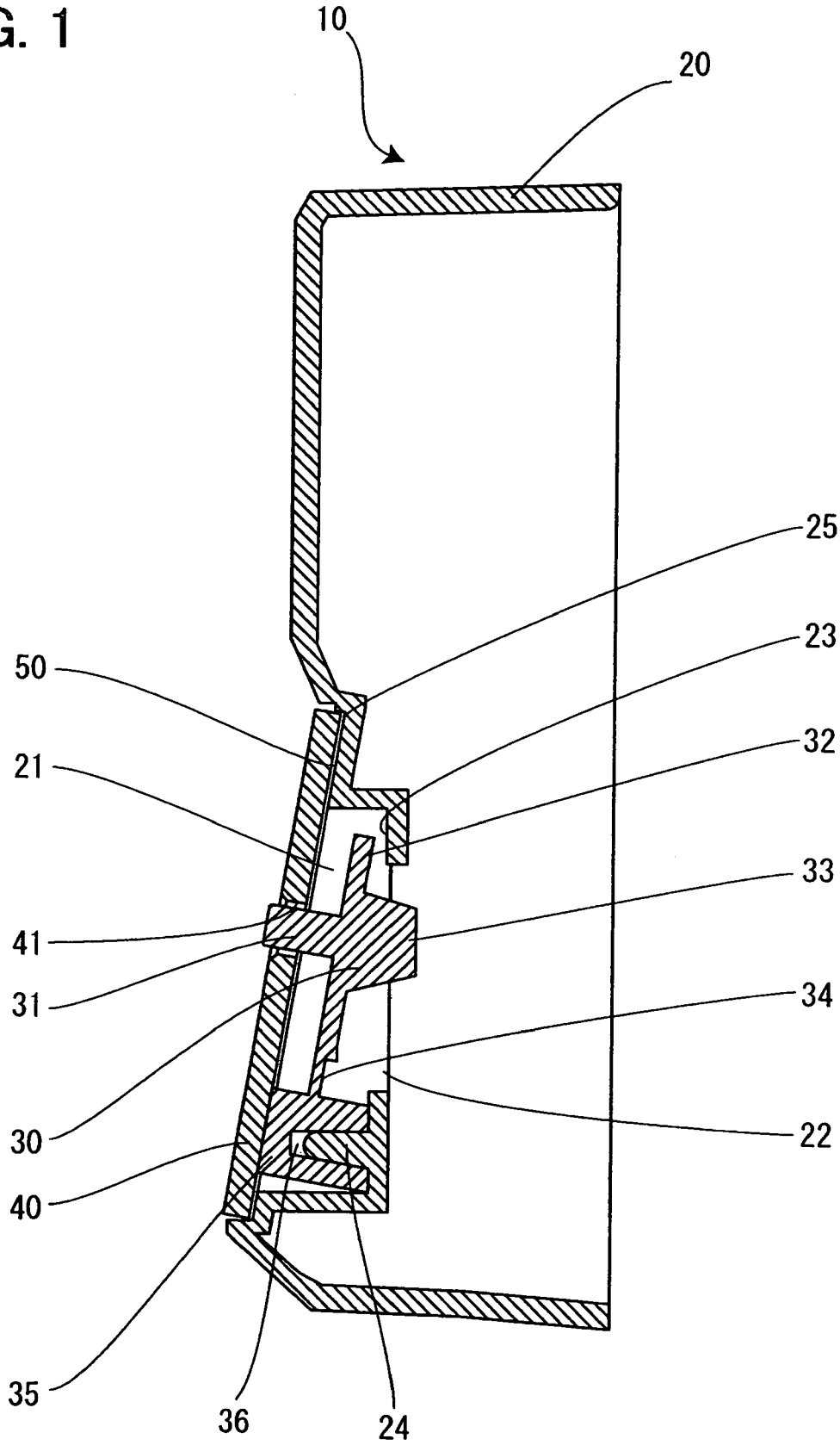
FIG. 1 is a side sectional view showing that an operation button and a decorative plate have been mounted on a front panel, the view illustrating an embodiment of the present invention.
Figure 7:
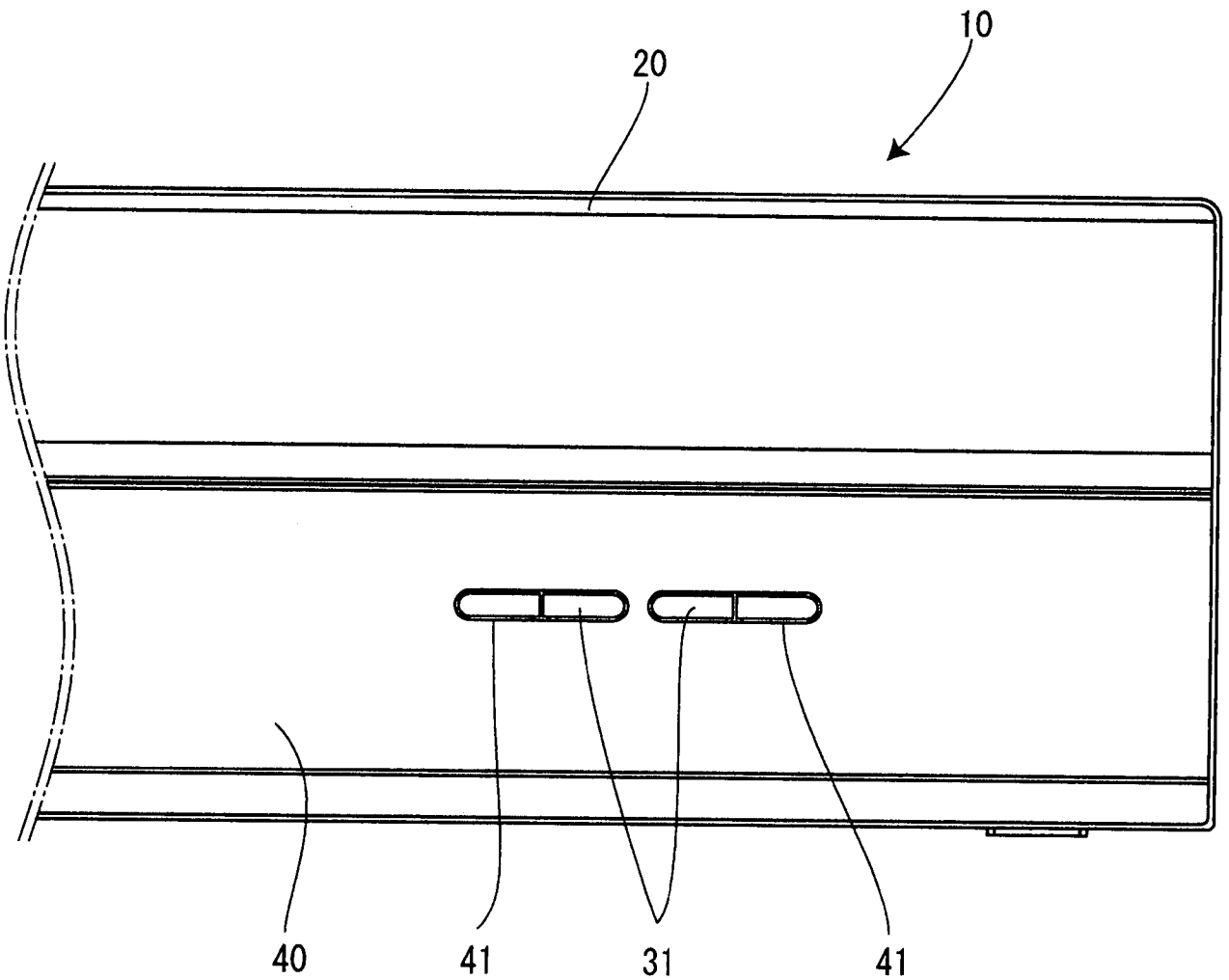
FIG. 7 is a partial front view illustrating that the operation button and the decorative plate have been mounted on the front panel yet in accordance with the present invention.

Now, with reference to FIGS. 1 and 7 and FIG. 4, previously described, description will be given of a mounting structure for a decorative panel 40 and the mounted state of the decorative panel. FIG. 1 is a side sectional view showing that the operation button and the decorative plate have been mounted on the front panel. FIG. 7 is a partial front view showing that the decorative plate has been mounted on the front panel. In FIG. 4, a through-hole 41 is opened in the decorative plate 40 so that the operating portion 31 of the operation button 30 can be inserted through the through-hole 41. To mount the decorative panel 40 on the front panel 20, the present embodiment uses a pressure sensitive adhesive double coated tape 50 as shown in FIG. 4. Thus, the decorative panel 40 can be mounted on the front panel 20 by attaching the pressure sensitive adhesive double coated tape 50 to the step portion 25 of the front panel 20 or to the decorative plate 40 and inserting the operating portion 31 of the operation button 30 already mounted on the front panel 20, through the through-hole 41, opened in the decorative panel 40, while fixedly bonding the decorative panel 40 to the step portion 25 of the front panel 20. Consequently, as shown in FIG. 7, in the front surface of the DVD apparatus 10, the decorative panel 40 is mounted on the front panel 20, and the two operating portions 31 of the operation button 30 are arranged in the respective through-holes 41, opened in the decorative panel 40; in total, the four operating portions 31 are arranged. The decorative plate 40 esthetically covers the button mounting portion 21 in which the operation button 30 is placed.

As described above, according to the present embodiment, in the DVD apparatus 10, which is the electronic apparatus with the operation button in accordance with the present invention, the operation button 30 is positioned and held in the button mounting portion 21 by fitting the convex portion 24, formed on the button mounting portion 21 of the front panel 20, into the concave portion 36, formed in the support portion 35 of the operation button 30. The decorative plate 40, covering the front surface of the operation button 30, serves to hold the operation button 30 between the button mounting portion 21 and the decorative plate 40. With the operation button 30, installed in the button mounting portion 21, when the operating portion 31, exposed from the through-hole 41 in the decorative plate 40, is pushed, the hinge portion 34 is bent to enable the pushing portion 33, formed on the rear surface of the operation button 30, to operate the internal switch. This eliminates the need to form a pedestal used to fix the operation button 30 as in the prior art; the formation of the pedestal complicates the shape of a mold for the case to increase mold costs. This in turn obviates the need for a tightening operation such as screwing or fusion which is conventionally used as means for fixing the operation button 30. It is thus possible to reduce the number of parts required for and thus the costs of the electronic apparatus such as the DVD apparatus 10. It is further possible to reduce the number of assembly steps required and thus the time required for operations.

Further, the stopper portion 23 is formed on the button mounting portion 21. The abutting portion 32 is formed on the operation button 30. Consequently, when the operating portion 31 is pushed to bend the hinge portion 34, the abutting portion 32, formed on the operation button 30, abuts against the stopper portion 23, formed on the button mounting portion 21. This inhibits the operation button 30 from being excessively pushed into the DVD apparatus 10. This makes it possible to prevent a decrease in the lifetime of the operation button 30 or damage to the switch (not shown) pushed by the abutting portion 32. Moreover, the stopper portion 23 is formed on the button mounting portion 21. This eliminates the need to form a stopper portion 23 as a separate member, thus easing a burden associated with the management of parts. Furthermore, the decorative plate 40 is fixedly bonded to the button mounting portion 21 using the pressure sensitive adhesive double coated tape 50. This enables the operation button 30 to be sandwiched and held between the decorative plate 40 and the button mounting portion 21. Thus, when a defect such as damage occurs in the operation button 30, the operation button 30 can be easily replaced with a new one simply by externally removing the decorative plate 40 externally from the DVD apparatus 10, merely bonded to the button mounting portion 21 using the pressure sensitive adhesive double coated tape 50, and removing the operation button 30, merely fitted around the convex portion 24 of the button mounting portion 21. This makes it possible to easily and quickly replace the operation button 30 with a new one without the need to disassemble the members mounted inside the DVD apparatus 10.

The present embodiment has been described in detail. However, the present invention is not limited to the above embodiment. Many variations may be made to the embodiment without departing from the spirit of the present invention. For example, the electronic apparatus with the operation button is not limited to the DVD apparatus 10. The present invention is also applicable to a composite machine of the DVD apparatus 10 and an HDD apparatus, a television, a composite machine of a television and the DVD apparatus 10, or the like provided that the electronic apparatus has the operation button 30 placed on the front panel 20. Further, provided that the operation button 30 is sandwiched between the front panel 20 and the decorative plate 40 and that the operation button 30 can be mounted and removed through the front surface of the front panel 20, the concave portion 36 of the fitting structure, used to mount the operation button 30 on the front panel 20, may be formed in the front panel 20 rather than in the operation button 30. Then, the convex portion 24 may be placed on the operation button 30 and over or on the left or right of the opening 22 rather than under the opening 22. Moreover, the decorative plate 40 may be mounted by forming a hook on one of the decorative plate 40 and the front panel 20 and engaging the hook with an engaging hole formed in the other of the decorative plate 40 and the front panel 20. That is, the structure used may be appropriately selected by, for example, making changes taking into account the easiness with which the electronic apparatus is assembled as well as the operability of the electronic apparatus.

According to the first aspect, the operation button is positioned and held in the button mounting portion by fitting the convex portion formed on one of the button mounting portion and operation button into the concave portion formed in the other of the button mounting portion and operation button. The decorative plate covering the front surface of the operation button allows the operation button to be held between the button mounting portion and the decorative plate. This eliminates the need to form a pedestal used to fix the operation button as in the prior art; the formation of the pedestal complicates the shape of a relevant mold to increase mold costs. This in turn obviates the need for a tightening operation such as screwing or fusion which is conventionally used as means for fixing the operation button. It is thus possible to reduce the number of parts required and thus the costs of the electronic apparatus. It is further possible to reduce the number of assembly steps required and thus the time required for operations.

According to the second aspect, the stopper portion is formed on the button mounting portion. This eliminates the need to form a stopper portion as a separate member, thus easing a burden associated with the management of parts.

According to the third or fourth aspect, the decorative plate is fixedly bonded to the button mounting portion using the pressure sensitive adhesive double coated tape. Thus, when a defect such as damage occurs in the operation button, the operation button can be easily replaced with a new one simply by externally removing the decorative plate, mounted on the button mounting portion, and removing the operation button, merely fitted around the convex portion of the button mounting portion. This makes it possible to easily and quickly replace the operation button with a new one without the need to disassemble the members mounted inside the electronic apparatus.

What is claimed is:

1. An electronic apparatus with an operation button which is placed on a front panel and in which a front surface of the operation button except for its operating portion is covered with a decorative panel, the operating portion being pushed to allow a pushing portion to operate an internal switch, the pushing portion projecting from a rear surface of the operation button, wherein the front panel is provided with a button mounting portion on which the operation button is mounted for storage and the button mounting portion is provided with an opening through which the pushing portion is inserted, wherein a convex portion is integrally formed on one of the button mounting portion and the operation button and a concave portion is formed in the other of the button mounting portion and the operation button, the concave portion being fitted around the convex portion to position and hold the operation button in the button mounting portion, the concave portion and the convex portion fix the operation button to the button mounting portion and wherein the operation button is provided with a hinge portion that is bent by pushing the operating portion so that the pushing portion operates the internal switch.

2. The electronic apparatus with the operation button according to claim 1, wherein the operation button is mounted in the button mounting portion so that a gap is created between the operation button and the button mounting portion by the concave portion and the convex portion, a stopper portion is provided on the button mounting portion, and an abutting portion that can be abutted against the stopper portion is formed on the operation button so that when the operating portion is pushed, the abutting portion is abutted against the stopper portion to inhibit the operation button from being excessively pushed into the electronic apparatus.

3. The electronic apparatus with the operation button according to claim 1, wherein the decorative plate is fixedly bonded to the button mounting portion using a pressure sensitive adhesive double coated tape so that the operation button is sandwiched and held between the decorative panel and the button mounting portion.

4. The electronic apparatus with the operation button according to claim 2, wherein the decorative plate is fixedly bonded to the button mounting portion using a pressure sensitive adhesive double coated tape so that the operation button is sandwiched and held between the decorative panel and the button mounting portion.

* * * * *